US010049534B2

(12) United States Patent
St. George et al.

(10) Patent No.: US 10,049,534 B2
(45) Date of Patent: Aug. 14, 2018

(54) CASH DRAWER HAVING A NETWORK INTERFACE

(75) Inventors: Paul St. George, Vadnais Heights, MN (US); Patrick Vue, Champlin, MN (US)

(73) Assignee: APG Cash Drawer, Minneapolis, MN (US)

( * ) Notice: Subject to any disclaimer, the term of this patent is extended or adjusted under 35 U.S.C. 154(b) by 0 days.

(21) Appl. No.: 12/983,493

(22) Filed: Jan. 3, 2011

(65) Prior Publication Data

US 2011/0172960 A1 Jul. 14, 2011

Related U.S. Application Data

(60) Provisional application No. 61/293,378, filed on Jan. 8, 2010.

(51) Int. Cl.
*G07G 1/14* (2006.01)
*G07G 1/00* (2006.01)

(52) U.S. Cl.
CPC ..... *G07G 1/14* (2013.01); *G07G 1/0018* (2013.01)

(58) Field of Classification Search
CPC . G06Q 20/20; G06Q 30/0238; G06Q 30/0268
USPC ..... 235/10; 702/179, 187–189; 705/16, 17, 705/21
See application file for complete search history.

(56) References Cited

U.S. PATENT DOCUMENTS 3,899,775 A * 8/1975 Larsen ..... 705/21
4,101,745 A 7/1978 Smith
4,255,697 A * 3/1981 Buhler, III ..... 320/124
RE32,456 E * 7/1987 Ishii ..... 200/61.61
4,829,429 A 5/1989 Komai et al.
5,983,202 A 11/1999 Yabe et al.
5,991,410 A 11/1999 Albert et al.
6,056,087 A * 5/2000 Addy et al. ..... 186/61
6,072,894 A 6/2000 Payne
6,282,516 B1 * 8/2001 Giuliani ..... G06Q 20/20 705/14.25
6,415,341 B1 7/2002 Fry et al.
6,626,354 B1 * 9/2003 Baitz et al. ..... 235/7 R
(Continued)

FOREIGN PATENT DOCUMENTS

CN 101883508 A 11/2010
KR 10-2010-0027839 A 3/2010
KR 10-2010-0061628 A 6/2010

OTHER PUBLICATIONS

Specification of the Bluetooth System, Version 1.1, Feb. 22, 2001 as in the IDS.*

(Continued)

*Primary Examiner* — Ricky Ngon
(74) *Attorney, Agent, or Firm* — Kelly, Holt & Christenson, PLLC

(57) ABSTRACT

Cash drawers having a network interface and a processing unit are disclosed. The network interface connects to a network. The processing unit detects cash drawer events and transmits an indication of the cash drawer events across the network interface. The cash drawer optionally includes a storage component that stores the indication of the cash drawer events. The network interface may be a wired or a wireless interface. The cash drawer may receive electrical power from an external supply or from the network connection.

19 Claims, 9 Drawing Sheets

(56) References Cited

U.S. PATENT DOCUMENTS

| | | | | |
|---|---|---|---|---|
| 6,629,019 | B2 | 9/2003 | Legge et al. | |
| 6,739,501 | B2 | 5/2004 | Murakami et al. | |
| 6,792,394 | B1 * | 9/2004 | Matsko et al. | 702/187 |
| 6,965,294 | B1 | 11/2005 | Elliot et al. | |
| 6,967,579 | B1 | 11/2005 | Elizondo | |
| 6,983,836 | B2 * | 1/2006 | Adams et al. | 194/302 |
| 7,158,026 | B2 | 1/2007 | Feldkamp et al. | |
| 7,254,625 | B2 * | 8/2007 | Gluska et al. | 709/222 |
| 7,360,685 | B2 * | 4/2008 | Keohane et al. | 235/379 |
| 7,366,681 | B2 | 4/2008 | Carter | |
| 7,474,330 | B2 * | 1/2009 | Wren et al. | 348/150 |
| 7,677,440 | B2 * | 3/2010 | Crockett et al. | 235/375 |
| 7,686,216 | B2 * | 3/2010 | Walczyk et al. | 235/383 |
| 7,784,684 | B2 | 8/2010 | Labrou et al. | |
| 7,847,675 | B1 | 12/2010 | Thyen et al. | |
| 7,850,076 | B1 * | 12/2010 | Dorenbaum | G06Q 40/02 109/2 |
| 7,917,769 | B2 | 5/2011 | Campisi | |
| 8,025,214 | B1 * | 9/2011 | Folk et al. | 235/379 |
| 8,313,020 | B2 | 11/2012 | Ramachandran | |
| 8,928,456 | B2 | 1/2015 | St. George et al. | |
| 9,129,493 | B2 | 9/2015 | St. George et al. | |
| 2002/0020743 | A1 | 2/2002 | Sugukawa et al. | |
| 2002/0172190 | A1 * | 11/2002 | Vatanen | 370/352 |
| 2003/0065566 | A1 * | 4/2003 | Kodaka et al. | 705/16 |
| 2003/0120920 | A1 * | 6/2003 | Svensson | 713/168 |
| 2004/0111360 | A1 | 6/2004 | Albanese | |
| 2005/0197935 | A1 * | 9/2005 | Tseng | G06Q 40/00 705/35 |
| 2005/0229016 | A1 * | 10/2005 | Addy | 713/300 |
| 2005/0242176 | A1 | 11/2005 | Roberge et al. | |
| 2005/0283403 | A1 * | 12/2005 | Ramirez | G06Q 20/20 705/16 |
| 2006/0031503 | A1 | 2/2006 | Gilbert | |
| 2007/0194105 | A1 | 8/2007 | Kissick | |
| 2009/0050684 | A1 * | 2/2009 | Crockett | G06Q 20/20 235/375 |
| 2009/0254444 | A1 * | 10/2009 | Harada | G06Q 20/20 705/18 |
| 2010/0001063 | A1 | 1/2010 | Bowles et al. | |
| 2010/0010901 | A1 * | 1/2010 | Marshall et al. | 705/17 |
| 2010/0057813 | A1 | 3/2010 | Abe et al. | |
| 2010/0070392 | A1 * | 3/2010 | Brown | G06Q 20/042 705/30 |
| 2010/0217677 | A1 * | 8/2010 | Hershey | G06Q 20/04 705/21 |
| 2012/0062363 | A1 | 3/2012 | St. George et al. | |
| 2012/0233006 | A1 | 9/2012 | St. George et al. | |
| 2013/0072115 | A1 | 3/2013 | Dobyns | |
| 2013/0346027 | A1 | 12/2013 | St. George et al. | |
| 2014/0172606 | A1 * | 6/2014 | Bishop | G06Q 20/202 705/21 |
| 2016/0267460 | A1 * | 9/2016 | Lamba | G06Q 20/027 |

OTHER PUBLICATIONS

International Search Report and Written Opinion for International Application No. PCT/US2014/052541, dated Dec. 3, 2014, date of filing: Aug. 25, 2014, 13 pages.

Prosecution History for U.S. Appl. No. 14/010,126 including: Amendment with RCE dated Nov. 14, 2014, 10 pages.

Prosecution History from U.S. Appl. No. 13/299,744; Amendment dated Jul. 1, 2014, and Notice of Allowance dated Aug. 22, 2014. 20 pages.

Prosecution History from U.S. Appl. No. 13/472,907; Final Rejection dated Jul. 2, 2014. 19 pages.

Prosecution History from U.S. Appl. No. 14/010,126 including: Final Rejection dated May 30, 2014, Amendment after Final dated Jul. 7, 2014, and Advisory Action dated Jul. 10, 2014. 34 pages.

Star DK-AirCash Accessory, accessed Jul. 18, 2013. 2 pages.

Annette Langley "Looking to open your cash drawer with a Tablet or Smartphone? Star has the answer . . . " accessed Jul. 18, 2013. 2 pages.

Prosecution History from U.S. Appl. No. 13/299,744; including Application and Drawings filed Nov. 18, 2011, Final Rejection dated Jul. 23, 2013, Amendment filed Dec. 13, 2013, Final Rejection dated Feb. 25, 2014, Amendment with RCE filed Mar. 21, 2014, and Non-Final Rejection dated Apr. 14, 2014. 79 pages.

Prosecution History from U.S. Appl. No. 13/472,907: including Application and Drawings filed Mar. 16, 2012, Non-Final Rejection dated Sep. 23, 2013, and Amendment filed Feb. 24, 2014. 62 pages.

Prosecution History from U.S. Appl. No. 14/010,126 including;Application and Drawings filed Aug. 26, 2013, Non-Final Rejection dated Feb. 12, 2014, and Amendment filed May 12, 2014. 54 pages.

Prosecution History from U.S. Appl. No. 13/472,907; Amendment with RCE dated Oct. 24, 2014, 14 pages.

Prosecution History from U.S. Appl. No. 13/299,744; Notice of Allowance dated Oct. 29, 2014. 8 pages.

Non-Final Office Action from U.S. Appl. No. 13/472,907 dated Jan. 5, 2015, 20 pages.

Non-Final Office Action from U.S. Appl. No. 14/010,126 dated Feb. 13, 2015, 18 pages.

Prosecution History for U.S. Appl. No. 14/010,126 including: Final Office Action dated Aug. 28, 2015 and Amendment dated Apr. 27, 2015, 29 pages.

Prosecution History for U.S. Appl. No. 13/472,907 including: Issue Notification dated Aug. 19, 2015, Corrected Notice of Allowance dated Aug. 4, 2015, Notice of Allowance dated Jun. 19, 2015 and Amendment dated Feb. 20, 2015, 25 pages.

"Specification of the Bluetooth System-core, version 1.1." (Feb. 22, 2001), 1084 pages.

Prosecution History for U.S. Appl. No. 14/010,126 including: Non-Final Office Action dated Jan. 12, 2016, Amendment with RCE dated Nov. 17, 2015, Advisory Action dated Oct. 29, 2015 and Amendment After Final dated Oct. 15, 2015, 53 pages.

Issue Notification for U.S. Appl. No. 13/299,744 dated Dec. 17, 2014, 1 page.

Non-Final Office Action dated Mar. 9, 2017 for U.S. Appl. No. 14/010,126.

Third Written Opinion for Singapore Application No. 2012043204 dated Dec. 16, 2016, 5 pages.

Prosecution History for U.S. Appl. No. 14/010,126 including: Amendment with RCE dated Oct. 25, 2016, Final Office Action dated Aug. 10, 2016, and Amendment dated Apr. 12, 2016, 51 pages.

Search Report for Singapore Application No. 2012043204 dated Feb. 28, 2014, 4 pages.

Written Opinion for Singapore Application No. 2012043204 dated May 16, 2014, 6 pages.

International Preliminary Report on Patentability for PCT/US2014/052541, 9 pages.

* cited by examiner

| 302 | 304 | 306 | 308 | 310 |
|---|---|---|---|---|
| CD1 | 05272010 | 11:28:51 | 60 | 00 |
| CD1 | 05272010 | 11:28:57 | 12 | 22 |
| CD1 | 05272010 | 11:29:01 | 18 | 25 |
| CD1 | 05272010 | 11:29:05 | 50 | 00 |
| CD1 | 05272010 | 12:10:37 | 41 | 00 |
| CD1 | 05272010 | 12:14:35 | 40 | 00 |
| CD1 | 05272010 | 12:16:02 | 31 | 00 |

Fig. 3

CASH DRAWER HAVING A NETWORK INTERFACE

REFERENCE TO RELATED CASE

The present application is based on and claims the priority of provisional application Ser. No. 61/293,378 filed on Jan. 8, 2010, the content of which is hereby incorporated by reference in its entirety.

BACKGROUND

Cash drawers are commonly employed at point-of-sale (POS) locations such as retail businesses. Cash drawers are used to securely store currency, credit card receipts, and the like until a financial transaction occurs, at which time the drawer is opened to access the contents. Normally such cash drawers are spring-loaded and are opened by energizing a solenoid to release a latch. In a common mode of operation, opening of a cash drawer is initiated from a POS terminal.

SUMMARY

An aspect of the disclosure relates to cash drawers having a network interface and a processing unit. The network interface connects to a network. The processing unit detects cash drawer events and transmits an indication of the cash drawer events across the network interface. The cash drawer optionally includes a storage component that stores the indication of the cash drawer events. The network interface may be a wired or a wireless interface. Additionally, the cash drawer may receive electrical power from an external supply or from the network connection.

These and various other features and advantages that characterize the claimed embodiments will become apparent upon reading the following detailed description and upon reviewing the associated drawings.

BRIEF DESCRIPTION OF THE DRAWINGS

FIG. 1 is a diagram of an operating environment in which cash drawers having network interfaces may be incorporated in.

FIG. 3 is an illustration of an event log stored by a cash drawer.

DETAILED DESCRIPTION

Embodiments of the present disclosure include cash drawers that are connected to a network (e.g. an Ethernet network) through a network interface. Each cash drawer is a separate device or node on the network, instead of simply being a peripheral to another device such as POS terminal. A network connected cash drawer may provide several advantages. For instance, a network connected cash drawer may be operated by multiple devices (e.g. multiple POS terminals) connected to the network. Also for instance, asset management may be improved by tracking and remotely reporting cash drawer usage statistics. These and other possible advantages are discussed in greater detail below.

Figure 1:
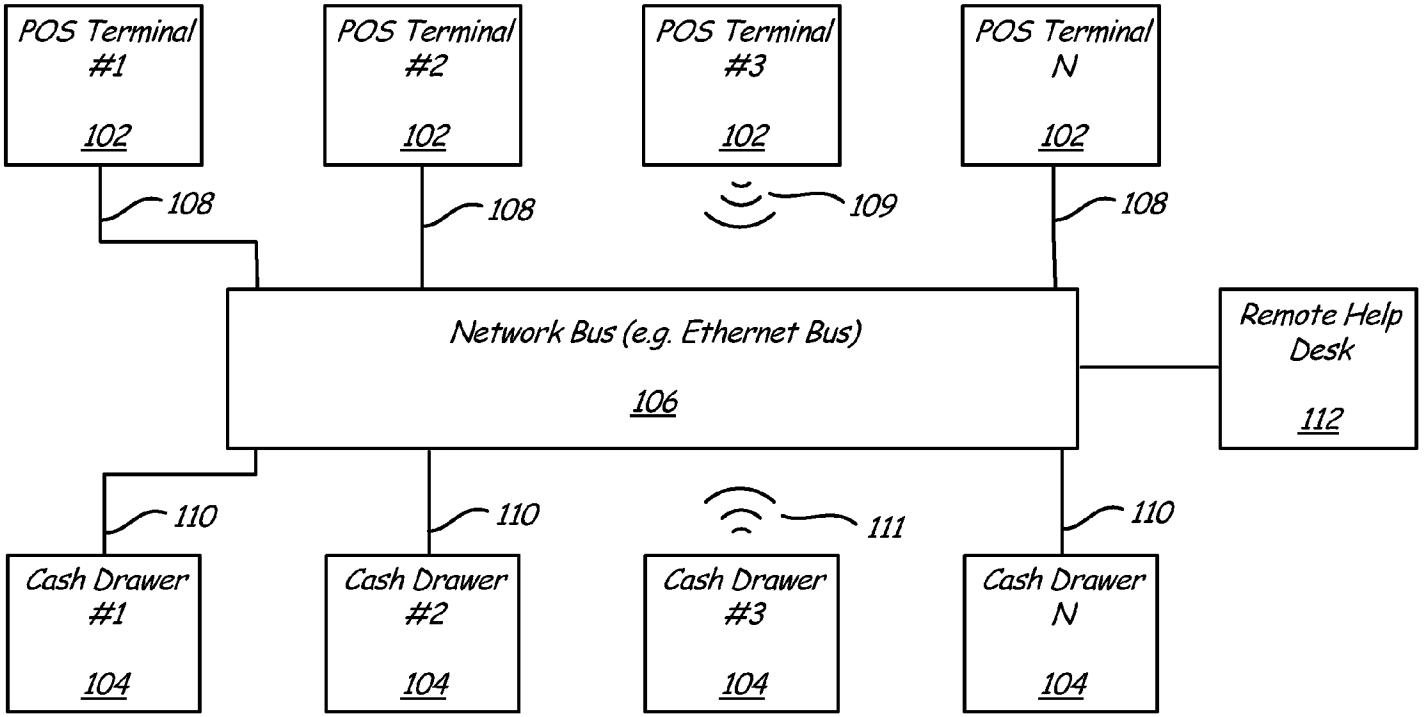

FIG. 1 shows one illustrative operating environment in which cash drawers having a network interface may be incorporated in. Embodiments are not however limited to any particular environment and may be practiced in environments different than that shown in FIG. 1.

FIG. 1 shows multiple POS terminals 102 and multiple cash drawers 104 connected to a network through a network bus 106. Any number of POS terminals 102 and any number of cash drawers 104 may be connected to a network bus 106. Network bus 106 allows for devices connected to it to be able to detect each other and to communicate with one another. For instance, devices connected to bus 106 illustratively send messages in the form of a data packet called a frame. Each frame optionally includes a source device address (e.g. a Media Access Control "MAC" identifier), a destination device address (e.g. a MAC identifier), the data to be transmitted (e.g. the payload data), and a cyclic redundancy check (e.g. a 32-bit cyclic redundancy check) which is used to detect any corruption of data during transit.

Each POS terminal 102 illustratively includes a user interface that enables a user to control one or more cash drawers 104. POS terminals 102 are not limited to any particular kind of or configuration of device. Some examples of devices that may be used for POS terminals 102 include thick or thin servers, personal computers, netbooks, cell phones/smart phones, personal digital assistants, tablet computers (e.g. an Apple iPad), etc.

POS terminals 102 are able to communicate commands to cash drawers 104 and receive information from cash drawers 104 through bus 106. Some examples of commands, for illustration purposes only and not by limitation, include an open drawer command, a prompt to have the cash drawer return its open/closed status command, a retrieve and clear event logs command, an assign user specific information into a cash drawer asset event log command, a controlled user access command to set a real time clock for date and time stamping of events, and a cash drawer audible alerts enable/disable command that optionally enables or disables an audible alert. For instance, an audible alert may be set to follow a cash drawer being opened by a POS terminal 102, a cash drawer being opened with a key, or a cash drawer not being closed after a specified time interval. Any other commands may also optionally be included within embodiments.

As is illustrated in FIG. 1, POS terminals 102 are able to connect to the network bus 106 through either a wired connection 108 or alternatively through a wireless connection 109. Embodiments are not limited to any particular connection scheme. Some examples of wireless connection 109 include connections using Wi-Fi (e.g. IEEE 802.11) or Bluetooth (e.g. 2402-2480 MHz) technologies.

In an embodiment, each POS terminal 102 is able to control and exchange information with each cash drawer 104. For instance, a POS terminal 102 is illustratively able to pick one of the several cash drawers 104 to communicate with (e.g. open). However, in another embodiment, POS terminals 102 may be restricted to which cash drawers 104 they have access to for security or other reasons. Embodiments are not limited to any particular configuration and may have other configurations as well.

Similar to POS terminals 102, cash drawers 104 may either have a wired connection 110 or alternatively have a wireless (e.g. Wi-Fi or Bluetooth) connection 111. Additionally, it should be noted that cash drawers 104 may be powered by an external power source (e.g. a connection to a wall outlet) or may be powered over the same line 110 that connects the cash drawer 104 to the network bus 106. For instance, cash drawer connection 110 may use Power over the Ethernet (PoE) technology such that the cash drawer receives power over the same line (e.g. a category 5 line) that transmits data.

FIG. 1 shows that an optional remote help desk 112 is also connected to network bus 106. Remote help desk 112 may be implemented as a server, personal computer, or any other computing device. Additionally, remote help desk 112 may connect to bus 106 through an internet connection (i.e. remote help desk 112 may be remotely connected to the network). Help desk 112 is illustratively able to communicate with all of the devices on the network bus 106 (i.e. POS terminals 102 and cash drawers 104). Help desk 112 may be used to troubleshoot issues with one or more devices on the bus 106, or may used for other functions such as asset management. For instance, help desk 112 in an embodiment is able to view statistics for each of the cash drawers 104 and management decisions (e.g. the decision to swap the physical locations of two cash drawers 104) can be made based on the statistics.

Figure 2:
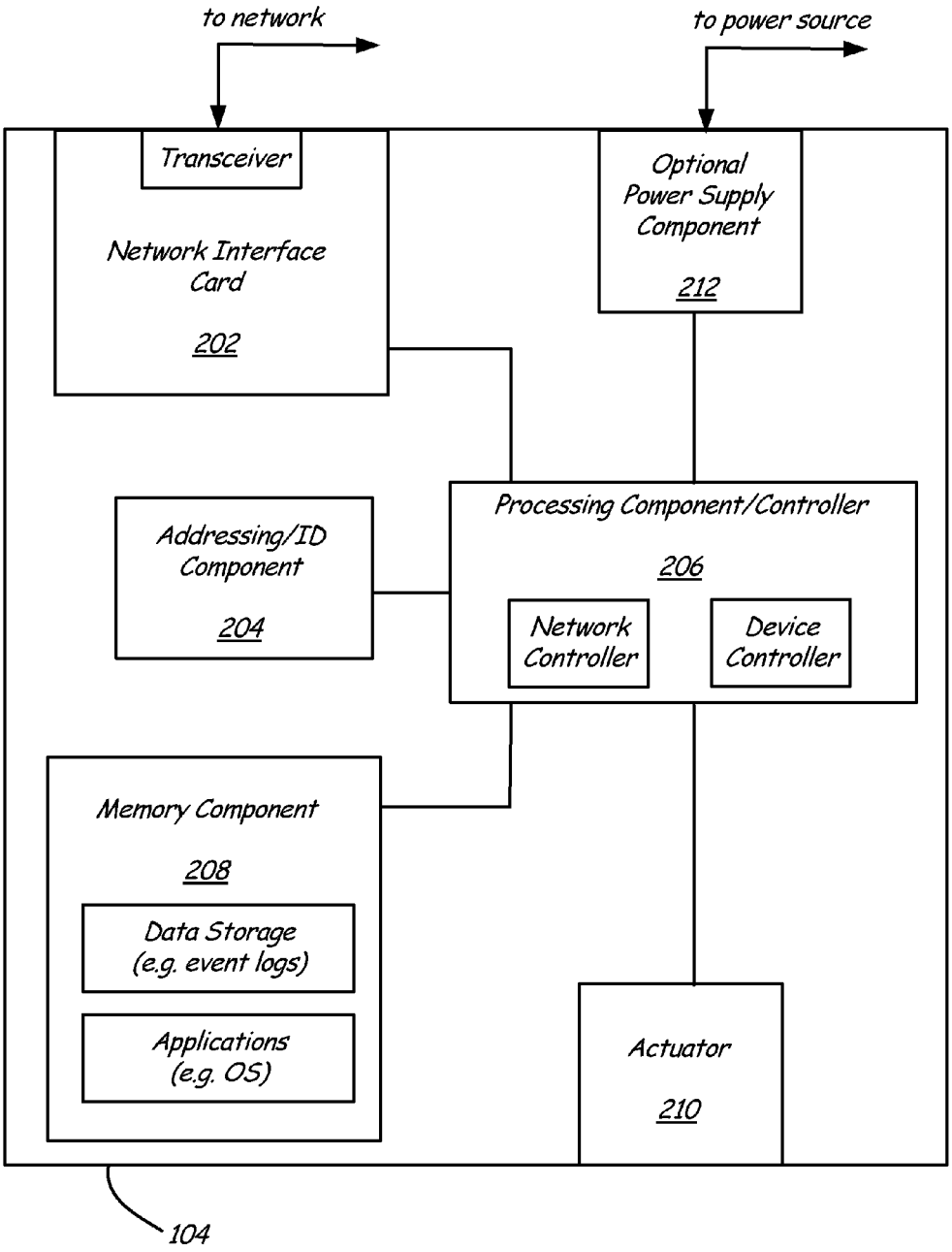
FIG. 2 is a schematic electrical diagram of a cash drawer having a network interface.

FIG. 2 is a schematic electrical diagram of a cash drawer 104. Cash drawer 104 includes a network interface card 202, an addressing component 204, a processing component/controller 206, a memory component 208, an actuator 210, and a power supply 212. Network interface card 202 includes a transceiver that is able to transmit data to and receive data from the network. As was previously mentioned, the transceiver may optionally use either a wired connection or use wireless technology to connect to the network.

Addressing/identification component 204 is used in identifying the cash drawer 104 to the network. In one embodiment, addressing component 204 includes a unique serial number that is used to uniquely identify the particular cash drawer from amongst any other device. The unique serial number may be used as part of a Media Access Control (MAC) address scheme utilized by the network. Embodiments of the present disclosure are not however limited to any particular addressing scheme and illustratively include any addressing scheme. Other examples of addressing schemes that may be used include those that use Dynamic Host Configuration Protocol (DHCP) IP address assignment and those that use static IP address assignment/re-assignment.

Processing component/controller 206 illustratively controls the operations of cash drawer 104. In one embodiment, controller 206 includes a network controller portion and a device controller portion. The network controller portion enables the cash drawer to be detected on the network and allows for communications to be transmitted between devices and applications on the network. For instance, the network controller portion receives commands for cash drawer operations and also sends cash drawer information (e.g. log data) to a requesting device and/or application.

The device controller portion stores cash drawer device information and event log entries. The log entries are for example stored in a non-volatile memory to ensure that data is not lost when the drawer is disconnected from the network, powered down, or moved to another network. The device controller portion also monitors an actuator 210 (e.g. a micro-switch) inside the cash drawer that monitors the open/closed status and that provides an electrical pulse that energizes a solenoid to release a latch that allows the cash drawer to be opened. Furthermore, the device controller portion may support auxiliary hardware that provides feedback of cash drawer operations or status such as, but not limited to, lights (e.g. LEDs) that report status and/or audible alerts that inform users or managers nearby if the cash drawer has been opened.

Memory component 208 includes any type or combination of memory that may be useful in operation of cash drawer 104. In an embodiment, memory component 208 may include volatile and non-volatile memory. Information that should be retained despite a power loss is illustratively stored to non-volatile memory such as, but not limited to, a magnetic hard disk drive, flash memory, or battery backed DRAM. Some information that may be stored to non-volatile memory includes event log information and applications (e.g. an operating system or POS application).

Optional power supply component 212 facilitates any needed power conditioning, transformation, etc. that may be needed to power the other components of the cash drawer 104. For instance, in a situation in which cash drawer 104 receives power from an external power source (e.g. a 110 volt alternating current wall outlet), power supply component 212 converts the alternating current into one or more direct currents that are fed to the different components of the cash drawer. Similarly, in a situation in which cash drawer 104 receives power from Power over the Ethernet, power supply unit 212 performs any needed conversions/transformations of power so that the cash drawer components receive their electrical requirements.

FIG. 3 is an illustration of one embodiment of an event log that is generated by a cash drawer and is stored to its memory (e.g. non-volatile memory). Any information that is useful for maintaining, troubleshooting, or managing cash drawers may be stored in an event log. In the specific example shown in FIG. 3, the event log includes a cash drawer identifier 302 that uniquely identifies a cash drawer, a date indicator 304, a time indicator 306, an event identifier 308, and an event status identifier 310. Event identifier is illustratively a code that corresponds to a cash drawer event. Some cash drawer events that may be identified include a cash drawer open by a POS command, a cash drawer open by a manual actuation (e.g. by a key), a cash drawer close, a length of time a cash drawer remains open, a connection or disconnection between a cash drawer and a network, a power supply (e.g. DC adaptor) power up or power down, audible alert activations, etc. Event status identifier 310 may identify a status of an event such as successful, unsuccessful, unknown, or any other status that may be required or useful.

Figure 4:
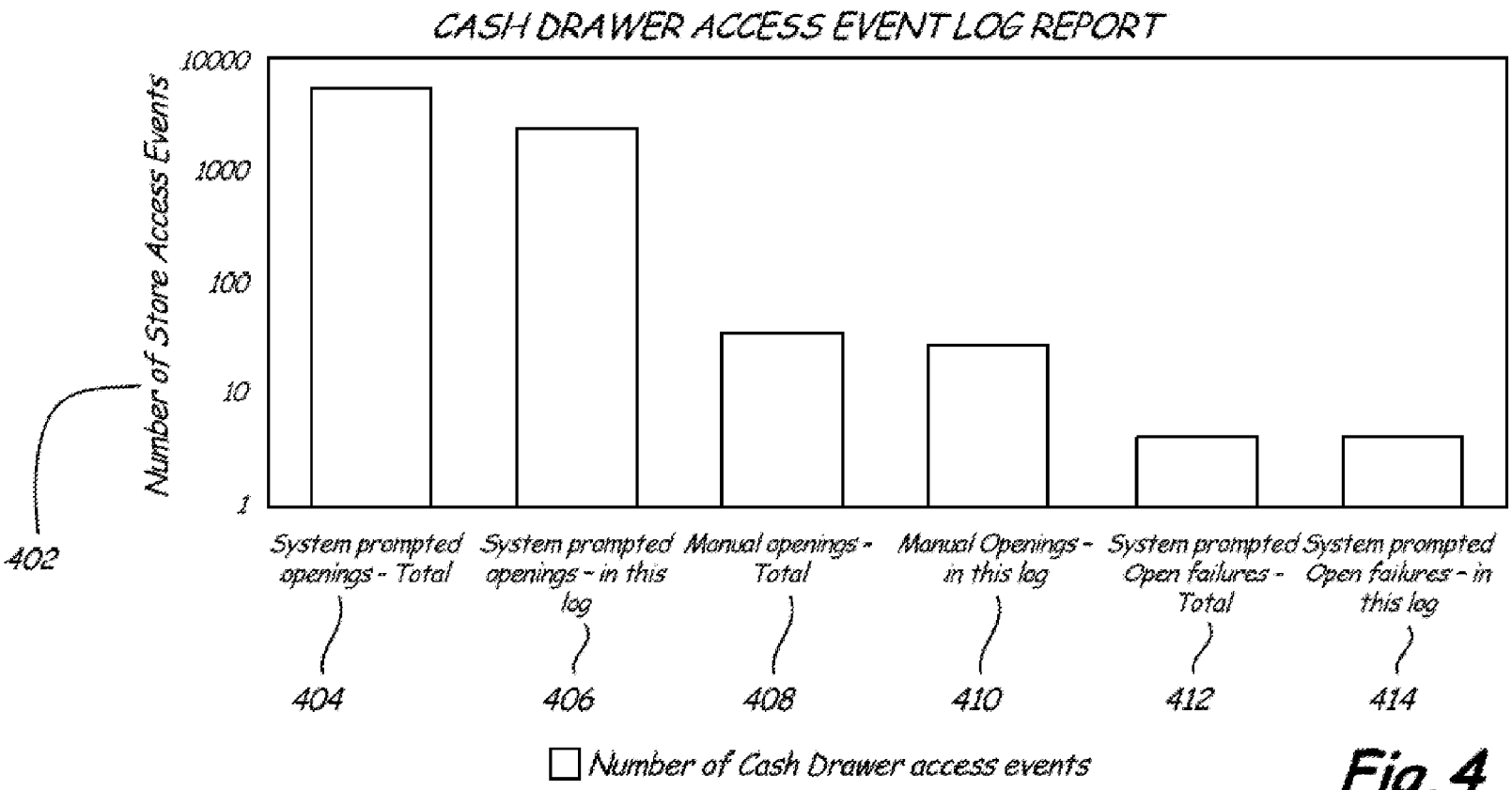
FIG. 4 is a user interface displaying cash drawer statistics.

In an embodiment, one or more devices (e.g. a POS terminal 102 and/or remote help desk 112 in FIG. 1) connected to a cash drawer 104 are able to retrieve and process event logs from cash drawers. For instance, a device may be able to perform and display statistics of a cash drawer. FIG. 4 shows one example of a user interface displaying statistics calculated for a cash drawer. In particular, FIG. 4 shows a "Cash Drawer Access Event Log Report." The vertical or y-axis includes a number of access events 402, and the horizontal or x-axis includes a description of an event. In the particular example shown in FIG. 4, the events along the horizontal axis include a total number of system prompted openings 404, a number of system prompted openings in this log 406, a total number of manual openings 408, a number of manual openings in this log 410, a total number of open failures for system prompted openings 412, and a number of open failures for system prompted openings in this log 414.

As can be seen in FIG. 4, one or more event logs from a cash drawer 104 may be processed to determine statistics for the performance of the cash drawer, and the statistics can be displayed in a graphical representation on a user interface. In the particular example shown in FIG. 4, the statistics are shown in the form of a bar graph. Embodiments are not however limited to any particular format and statistics may be shown in other formats such as textual representations, line graphs, pie charts, etc. Additionally, statistics for multiple cash drawers may be processed and/or displayed simultaneously. This would enable for instance for the performance of different cash drawers on a network to be compared.

Figure 5:
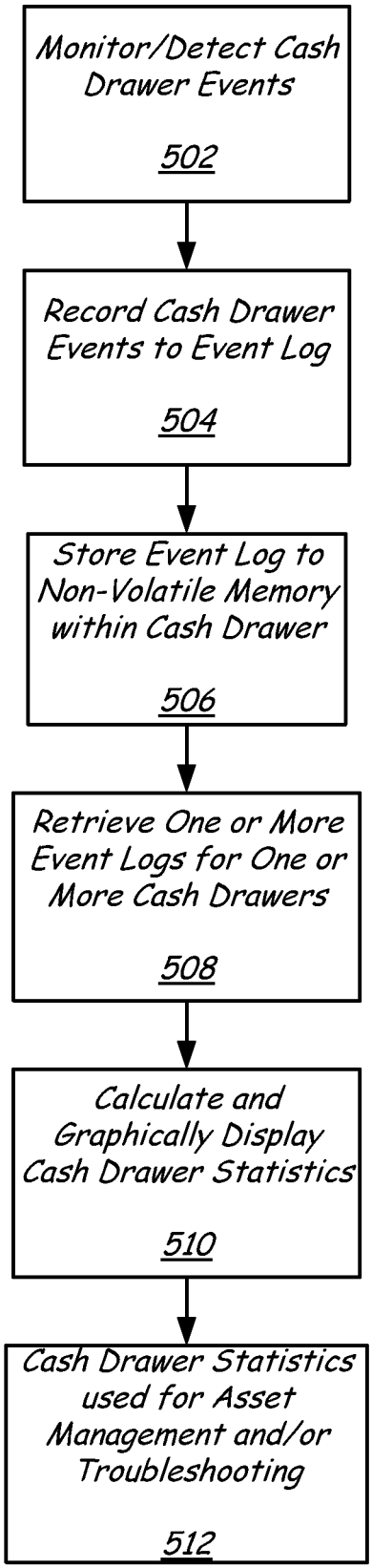
FIG. 5 is a flow chart of a method for troubleshooting cash drawer issues and/or for cash drawer asset management.

FIG. 5 shows an embodiment of one method according to the present disclosure. The method may be useful for example for troubleshooting cash drawer issues and/or for cash drawer asset management. At block 502, cash drawer events (e.g. an open command) are monitored or detected. At block 504, cash drawer events and any other related information (e.g. an event status) are stored to an event log. At block 506, the event log is saved to a non-volatile memory within a cash drawer. At block 508, one or more event logs for one or more cash drawers is retrieved. At block 510, the event log or logs are processed to calculate and display cash drawer statistics, and at block 512, cash drawer statistics are used for asset management and/or troubleshooting.

Figure 6:
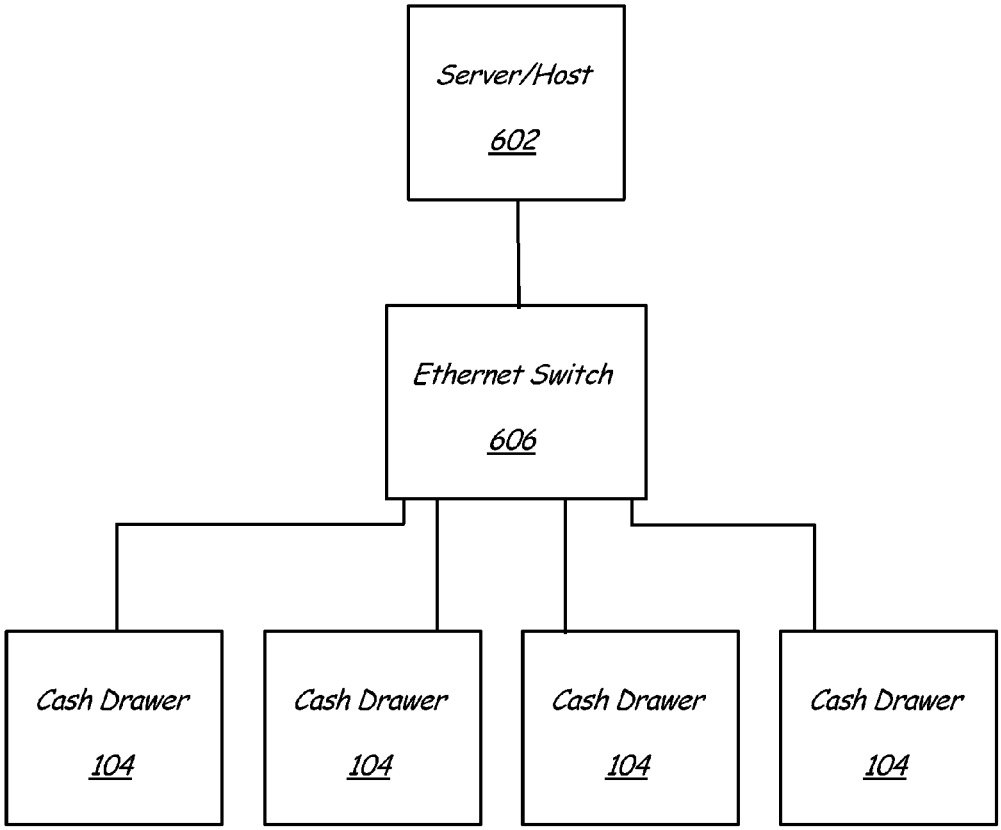
FIG. 6 is a diagram of one implementation of a cash drawer network.

FIG. 6 shows one particular implementation of a cash drawer network. In the implementation shown in FIG. 6, a server/host 602 connects to four cash drawers 104 through an Ethernet switch 606. Server/host 602 illustratively includes POS software and is able to connect to, communicate with, and control each of the cash drawers 104. Switch 606 processes and routes data between the server/host 602 and the cash drawers 104. Embodiments of the present disclosure are not however limited to any particular implementation and may include for example more or less cash drawers, hosts/servers, and or other devices. For example, embodiments are not limited to any particular devices for establishing a network and may include one or more switches, hubs, relays, repeaters, or other hardware/software configurations to establish a network. The embodiment shown in FIG. 6 is merely provided to show one example of a configuration within the scope of the present disclosure.

Figure 7:
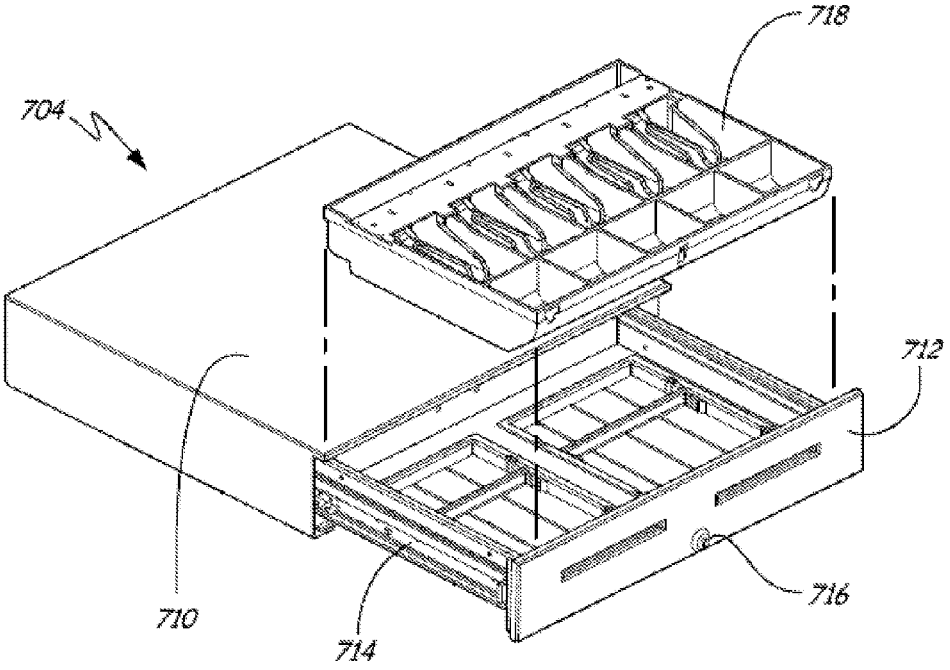
FIG. 7 is a perspective view of a cash drawer.
Figure 8:
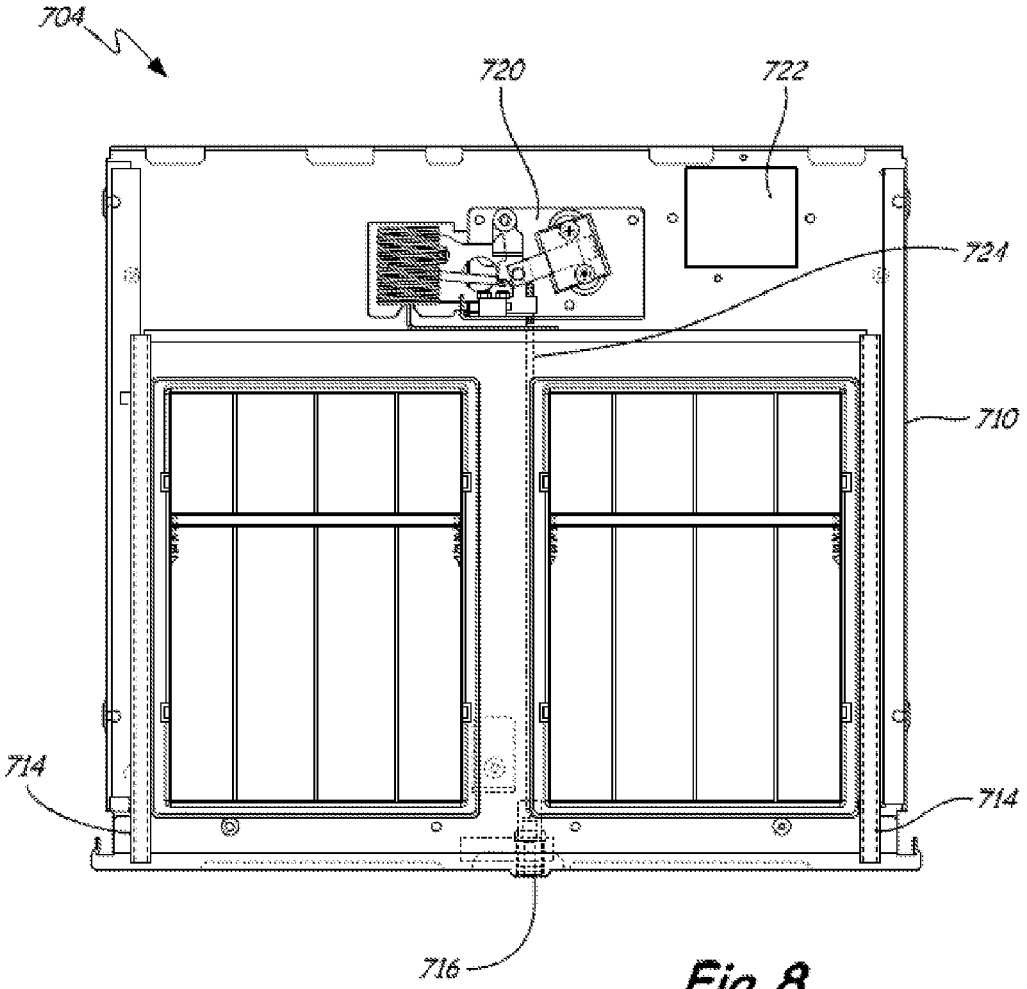
FIG. 8 is a top down view of the cash drawer of FIG. 7 with the top of the housing and the till having been removed.

FIGS. 7 and 8 show an example of a cash drawer 704 that may be used in some embodiments. Embodiments of the present disclosure are not however limited to any particular type of cash drawer, and embodiments illustratively include cash drawers having any configuration. FIG. 7 is a perspective view of cash drawer 704. FIG. 7 shows that cash drawer 704 includes a drawer housing 710, a moveable drawer 712, a set of slides 714 that enable drawer 712 to move into and out of housing 710, a manual open/close mechanism 716 (e.g. a key lock), and a removable till 718 for holding currency, receipts, etc.

FIG. 8 shows a top down view of cash drawer 704 with the top of the housing 710 and the till 718 having been removed. FIG. 8 shows that cash drawer 704 also includes a latch bracket assembly 720 for opening/closing the moveable drawer 712 and an electrical circuit board 722 having one or more electrical components for operating the drawer. For example, electrical circuit board 722 may include one or more of the electrical components shown in FIG. 2. Other embodiments of cash drawers 704 may include multiple circuit boards 722 and/or circuit boards with different locations (e.g. beneath moveable drawer 712). FIG. 8 further shows that cash drawer 704 includes a lock rod 724 that connects the manual open/close mechanism 716 to the latch bracket assembly 720. Lock rod 724 is illustratively used to release the latch within latch bracket assembly 720 to move drawer 712 into an open position.

Figure 9:
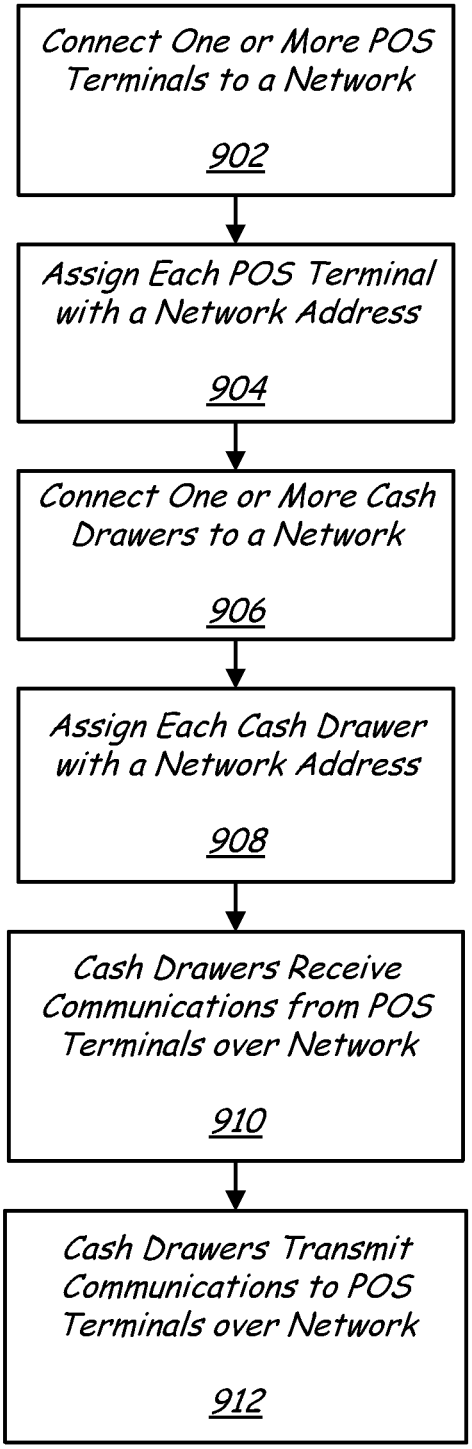
FIG. 9 is a flow chart of a method of communicating with a cash drawer over a network.

FIG. 9 shows an embodiment of a method of communicating with a cash drawer according to an embodiment of the present disclosure. At block 902, one or more POS terminals are connected to a network (e.g. an Ethernet network). The connections may be wireless (e.g. Wi-Fi or Bluetooth) or may be wired. At block 904, each POS terminal is addressed. Embodiments are not limited to any particular method of addressing. For instance, embodiments may receive a static or dynamic address. Embodiments may also receive a unique address such as an address based on their Media Access Control "MAC" identifier. At block 906, one or more cash drawers are connected to the network. The cash drawer connections may also be wireless or wired. At block 908, each cash drawer is addressed. Cash drawers may utilize any method of addressing such as the previously mentioned static and dynamic addressing, and may likewise receive a unique address such as, but not limited to, an address based on their MAC identifier. At block 910, cash drawers receive communications from POS terminals over the network, and at block 912, cash drawers transmit communications to POS terminals over the network. Embodiments are not limited to any particular methods of sending or receiving communications. However, in one embodiment, for illustration purposes only and not by limitation, communications are sent in the form of a data packet frame that includes a source device address, a destination device address, the data to be transmitted, and a cyclic redundancy check. Also, it should be mentioned that the data to be transmitted can include any data. For instance, a POS terminal can send a command such as a cash drawer open command, and a cash drawer can send data such as an event log.

As has been discussed above, embodiments of the present disclosure include cash drawers having interfaces that enable the cash drawers to be connected to a network (e.g. an Ethernet network). Each cash drawer acts as a node on the network as a free-standing network device. The cash drawers are not simply devices that are physical peripherals to a host PC. In at least certain embodiments, cash drawers generate and store event logs that may be useful for tasks such as device troubleshooting and/or asset management. Additionally, one or more event logs may be processed to generate cash drawer statistics which may be graphically displayed to a user. Accordingly, embodiments of cash drawers of the present disclosure may be advantageous in at least certain situations over other cash drawers which may not be connectable to a network and/or may not have event logs.

Finally, it is to be understood that even though numerous characteristics and advantages of various embodiments have been set forth in the foregoing description, together with details of the structure and function of various embodiments, this detailed description is illustrative only, and changes may be made in detail, especially in matters of structure and arrangements of parts within the principles of the present disclosure to the full extent indicated by the broad general meaning of the terms in which the appended claims are expressed. In addition, although the embodiments described herein are directed to cash drawers, it will be appreciated by those skilled in the art that the teachings of the disclosure can be applied to other types of systems, without departing from the scope and spirit of the disclosure.

What is claimed is:

1. A point-of-sale system comprising:

a wireless network;

a point-of-sale terminal comprising a point-of-sale identifier configured to identify the point-of-sale terminal to the wireless network; and a cash drawer comprising:

a wireless network interface that directly connects the cash drawer to the wireless network;

a processing unit configured to detect a cash drawer event and transmit an indication of the detected cash drawer event directly to the wireless network;

an addressing component configured to provide a cash drawer identifier, wherein the cash drawer identifier is configured to identify the cash drawer to the wireless network such that the cash drawer is interchangeably coupleable to the point-of-sale terminal and a second point-of-sale terminal;

a non-transitory event storage component that stores the indication of the cash drawer event, wherein the indication is stored such that it is accessible for later retrieval; and wherein the cash drawer identifier is different from the point-of-sale identifier such that the cash drawer and the point-of-sale terminal are separately and uniquely identified, and communicably coupled to, the wireless network.

2. The system of claim 1, wherein the cash drawer receives electrical power from an external supply.

3. The cash drawer of claim 1, wherein the wireless network interface connects, simultaneously, the cash drawer to more than one device over the wireless network.

4. The cash drawer of claim 1, wherein the point-of-sale terminal is interchangeably coupleable to the cash drawer and a second cash drawer.

5. A cash drawer comprising:

a cash drawer housing;

a moveable drawer that fits within the housing;

a processor specific to, and associated with, the cash drawer;

a transceiver configured to, when directed by the processor:

send information to a network, wherein sending information to a network comprises sending an indication of a cash drawer event detected by the processor; and receive information from the network, wherein information from the network at least comprises a command;

an addressing component configured to identify the cash drawer to the wireless network, wherein the addressing component includes a unique identifier specific to the cash drawer, such that the unique identifier is distinct from a point-of-sale identifier, and wherein the cash drawer is configured to directly communicate with a first point of sale system and, interchangeably, directly communicate with another device over the network using the unique identifier; and wherein each indication of cash drawer event comprises at least:

a time stamp indicating a time when the event occurred;

a date stamp;

the unique identifier for the cash drawer on which the event occurred; and an open/closed status of the cash drawer.

6. The cash drawer of claim 5, further comprising:

wherein the processor generates an event log based on the detected cash drawer event.

7. The cash drawer of claim 6, further comprising:

a non-transitory memory component that stores the event log for later access.

8. The cash drawer of claim 5, wherein the transceiver is disposed within the cash drawer housing.

9. The cash drawer of claim 5, wherein the cash drawer receives power from a network connection.

10. The cash drawer of claim 5, wherein the addressing component comprises a unique serial number that is used as part of an address scheme utilized by the network, the address scheme comprising at least one of dynamic address assignment and static address assignment.

11. The cash drawer of claim 5, wherein the cash drawer is configured to receive commands from a device that communicate with the cash drawer over the network.

12. The cash drawer of claim 5, wherein the other device comprises the point-of-sale device that transmits signals to the cash drawer over the network to operate the cash drawer.

13. The cash drawer of claim 5, wherein the cash drawer is further configured to be located within a point-of-sale system, such that the unique cash drawer network address is different from a network address associated with the point-of-sale device.

14. The cash drawer of claim 5, wherein the transceiver is wirelessly coupled to the network, and is configured to sending directly to, and receive information directly from, the network.

15. The cash drawer of claim 5, wherein the cash drawer receives information, over the network, from multiple point-of-sale devices simultaneously.

16. A method of generating an event log for a cash drawer, utilizing a processing component of a cash drawer, the method comprising:

detecting with the processing component, a cash drawer event;

storing the detected cash drawer event to an event log, wherein the cash drawer event is stored in a non-transitory file generated, by the processing component, in a computer memory component of the cash drawer such that event log is accessible for later retrieval and review;

assigning the cash drawer a unique network address, wherein the unique network address is specific to the cash drawer and distinct from an address associated with a peripherally connected terminal device such that the cash drawer and the peripherally connected terminal device are uniquely and distinctly identified on a network;

transmitting, using a network interface of the cash drawer, the stored event log from the cash drawer to a device across a network connection, wherein transmitting comprises a cash drawer communication component, communicably coupled to the device, directly communicating with the device across the network connection using the unique network address of the cash drawer; and wherein the cash drawer is part of a point-of-sale system including the peripherally connected terminal device, and wherein the terminal device has a point-of-sale network address unique and distinct from the unique address of the cash drawer such that the cash drawer can interchangeably connect to the terminal device and a second device on the network.

17. The method of claim 16, wherein the event log includes at least one of:

a cash drawer identifier;

an event identifier;

an event status; and a time and date identifier.

18. The method of claim 16, further comprising:

calculating a statistic based on a dataset of stored cash drawer events within the event log; and graphically displaying a report based on the calculated statistic.

19. The method of claim 16, and further wherein the computer memory component is a non-transitory memory component.

* * * * *